US005797356A

United States Patent [19]

Khizh

[11] Patent Number: 5,797,356

[45] Date of Patent: Aug. 25, 1998

[54] SIMPLEST HIGH EFFICIENCY UNIVERSAL WATER HEATER

[75] Inventor: Adam Khizh, New York, N.Y.

[73] Assignee: AGA Technologies, Inc., Langhorne, Pa.

[21] Appl. No.: 593,037

[22] Filed: Jan. 29, 1996

[51] Int. Cl.[6] ..... F22B 5/00

[52] U.S. Cl. ..... 122/17; 126/365; 126/387; 122/135.3

[58] Field of Search ..... 122/5.51, 17, 44.1, 122/44.2, 111, 48, 135.3, 155.5, 407, DIG. 7; 126/344, 361, 362, 365, 387

[56] References Cited

U.S. PATENT DOCUMENTS

| | | | |
|---|---|---|---|
| 1,961,231 | 6/1934 | Maier | 122/17 |
| 2,504,092 | 4/1950 | Thomas | 122/17 |
| 2,874,683 | 2/1959 | LaRue | 122/17 |
| 3,492,972 | 2/1970 | McLaren | 122/17 |
| 4,735,174 | 4/1988 | Crump | 126/362 |
| 4,838,211 | 6/1989 | Vago | 122/17 |
| 4,869,232 | 9/1989 | Narang | 126/362 |
| 4,884,555 | 12/1989 | Huang | 126/350 R |
| 4,920,925 | 5/1990 | Korenberg et al. | 122/149 |
| 5,220,888 | 6/1993 | Khinkis et al. | 122/136 R |

*Primary Examiner*—William Doerrler

*Attorney, Agent, or Firm*—Panitch Schwarze Jacobs & Nadel, P.C.

[57] ABSTRACT

A water heater having an insulated tank with a vertical flue pipe from a bottom to a top with two, bottom and top openings. Under the tank is located an air-blast gas burner and low pressure (from about 100 Pa) plenum blower. The burner nozzle is entered into the flue pipe through the bottom opening with a tangential direction to inside surface of the flue pipe and aslant up from horizontal to about 45°. On the flue pipe top is located a venting tangential outlet.

A method of combusting fuel, venting, and heating water comprising: mixing fuel and air in an amount of about 100% and more of the stoichiometric ratio for complete combustion, blowing the mixture with a velocity from about 10 meters/sec into a vertical flue pipe, complete combustion in the whirling stream flame, heating water mostly by convection heat transfer from whirling stream gases, and venting under a summary of the following actions: natural draft of hot gases, directed vertical up portion of a force, blowing in a jet the flue/air mixture, and directed tangential force from the whirling stream of gases.

18 Claims, 3 Drawing Sheets

SIMPLEST HIGH EFFICIENCY UNIVERSAL WATER HEATER

BACKGROUND

1. Field of Invention

This invention relates to a power vented water heater and a method of combusting a fuel and heating water. More particularly, it is related to a gas fired residential and commercial water heater wherein the products of combustion flow directly from the burner inside vertical flue through the tank with heated water.

2. Description of the Prior Art.

The common ordinary water heaters of the prior art (U.S. Pat. No. 4,672,919; 5,020,512; 5,199,385; 5,335,646 etc.) have typically relied upon the atmospheric injection gas burner located under the central vertical flue pipe of the tank with heating water. By action of natural draft of hot flue gases, or by means of the exhauster the products of combustion flow upwards through the flue pipe, which serves as a heat transfer surface for heating water. Different flue baffles can be placed into the flue pipe to increase coefficient of heat transmission. The thermal efficiency of these water heaters usually is 76–80%.

The reasons for such low thermal efficiency are the following: first, high temperature of the outlet products of combustion can reach 200° C. and second, extra air in products of combustion is 3–4 times above stiochiometric rate for complete combustion.

The first reason is a result of low thermal conductance factor from products of combustion to the flue pipe inside surface. The second reason is an atmospheric injection gas burner. These drawbacks are inherent in method of gas combustion and in order to eliminate them it is necessary to change a method of fuel combustion and a water heater construction, which is just suggested in present invention. Multi-flue constructions are used to increase a productivity of commercial water heaters, (e.g., by U.S. Pat. No. 4,157,077 (1979), 4,512,289 (1985) and others) with a lot of welds, which short a water heaters life. Moreover, special means are required to prevent a sedimentation in this wide tank, e.g., as in one of the last U.S. Pat. No. 5,341,770 (1994).

To increase an amount of heat transmission inside flue pipe different baffles are used. The patents of Oscar Bock in 1955 and 1960 on an internally finned flue provided additional heating surface and turbulence. With this "Turboflue" 30 Gal. water heater reached 140,000 BTU/H input. But these constrictions are very complicated and contain a great numbers of welds.

OBJECTS AND ADVANTAGES OF THE INVENTION

It is an object of the present invention to provide a water heater with the minimum requirement of a fuel, i.e., thermal efficiency 90–95%, for residential use from 20,000 BTU/H input as well as for commercial use up to 800,000 BTU/H input and the manufacturing cost of which is not greater than that of other ordinary residential models of the same productivity and much less than cost of the ordinary commercial models.

It is another advantage of the invention to provide a water heater capable of venting flue gases at a comparatively low temperature without an additional exhauster or a chimney stack.

It is a further advantage of the invention—to prolong life of water heaters by eliminating sedimentation of solid particles in a bottom of a water heater tank.

It is another object of this invention to provide very simple and effective method of combusting fuel, venting, and heating water in the water heater with vertical flue pipe.

Other objects and advantages of the present invention will become apparent to those skilled in the art from the drawings the detailed description of preferred embodiments and the appended claims.

SUMMARY OF THE INVENTION

A water heater according the present invention has an insulated tank with a water inlet and a water outlet and vertical flue pipe from a bottom to a top with two (bottom and top) openings. A burner which is connected with a low pressure (from about 100 Pa) plenum blower and a fuel source is located under the tank. The burner nozzle is entered into the flue pipe through the bottom opening with a tangential direction to inside surface of the flue pipe and aslant up from horizontal to about 45°. A venting tangential outlet is located on top of the flue pipe top. The cold water inlet has a nozzle which is directed tangential to the flue pipe into a bottom portion of the tank.

A method of combusting fuel, venting and heating water comprising: preparing a fuel/air mixture up to 100% and more of stoichiometric ratio for complete combustion, blowing the mixture with a velocity from about 10 meters/sec into a vertical flue pipe with a tangential direction to inside surface and aslant up from horizontal at angles to about 45°, complete combustion of the fuel/air mixture in the whirling stream-flame, heating water mostly by convection heat transfer from a whirling stream products of combustion, and venting products of combustion under a summary of the following actions: natural draft of hot gases, directed vertical up portion of force from aslant up blowing in a jet of the flue/air mixture, and directed tangential force from the whirling stream products of combustion at the flue pipe top.

DRAWING REFERENCE NUMERALS

Figure 1:
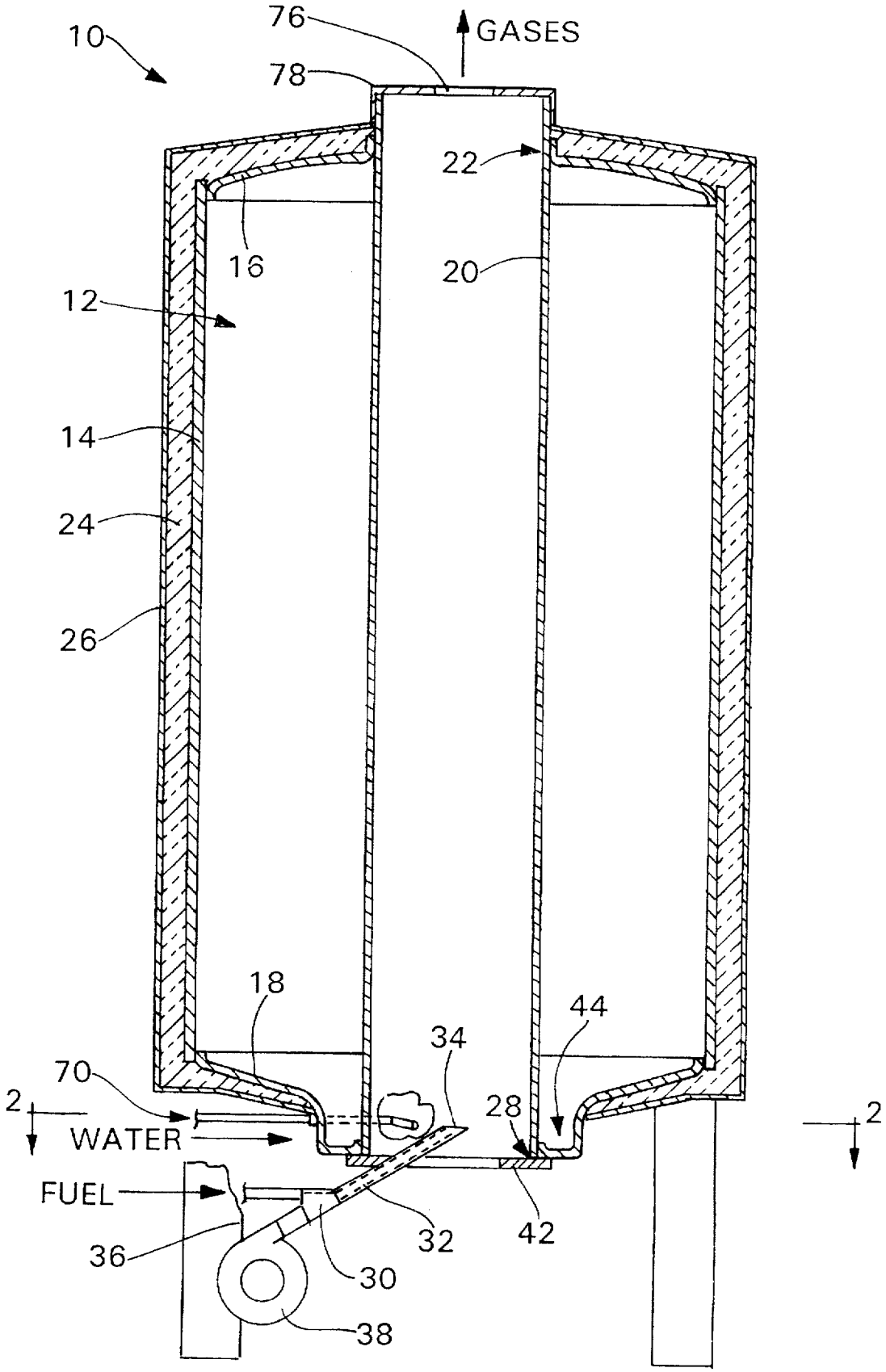
FIG. 1 is a schematic cross-sectional side view of a water heater illustrating one embodiment of the present invention.

10 water heater
12 tank for hot water
14 wall of 12
16 top of 12
18 bottom of 12

20 flue pipe
22 opening in 16
24 insulation of 12
26 jacket over 24
28 bottom end of 20
30 air-blast gas burner
32 nozzle for gas/air mixture
34 top end of 32
36 gas inlet into 30
38 plenum blower
40 circular opening in 42
42 bottom flange in 20
44 circular recess in 18
46 removable bottom of 20
48 high thermal conducting plate of 46
50 reflection screen of 46
52 hole in 46 for 32
54 fireproof tube screen into 20
56 fireproof removable bottom end of 20
58 body from metal sheet of 56
60 penetrating insulation of 56
62 air inlet in 58
64 air tube between 58 and 38
66 lower portion of 20
68 upper portion of 20
70 cool water inlet into 12
72 nozzle of 70
76 opening of 78
78 top cover on 20
80 injector for 82
82 tangential outlet for gases on 20
84 nozzle of 80
86 air tube between 80 and 38.

DESCRIPTION OF THE PREFERRED EMBODIMENT

It will be appreciated that the following description is invented to refer to the specific embodiment of the invention selected for illustration in the drawings and is not intended to define or limit the invention other than in the appended claims. Turning now to the specific form of the invention illustrated in the drawings and referring particularly to FIGS. 1 and 2, the number 10 designates a water heater in accordance with aspects of the invention.

Figure 2:
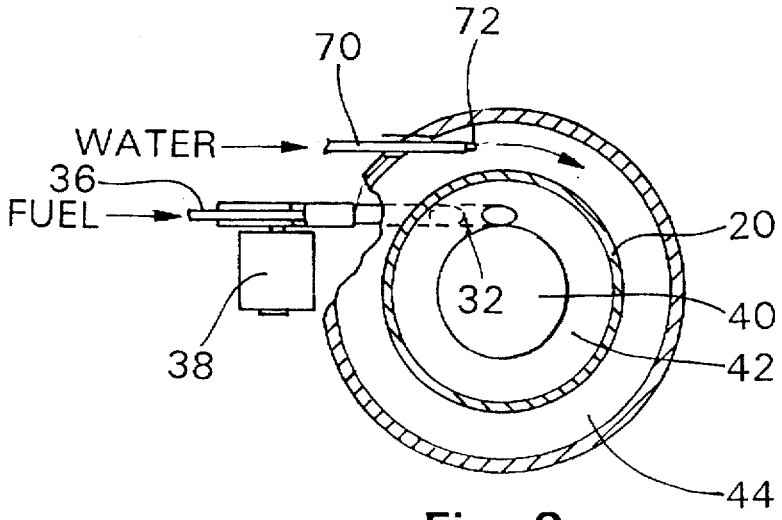
FIG. 2 is a broken away schematic cross-sectional top view taken on line 2—2 FIG. 1.

FIG. 1 shows water heater 10 taken in section to show the interior thereof. The water heater includes a liquid tight tank 12 comprised of a tank wall 14 and top and bottom head members 16 and 18 welded thereto. The tank 12 further includes a central flue pipe 20 welded to bottom head 18 and extending upwardly through an opening 22 in top head 16, to which it is welded. The tank 12 is surrounded by a body of insulation 24 which is in turn surrounded by an exterior jacket 26.

Under the tank 12 is located a burner 30 and a plenum blower 38. The burner 30 is "air-blast gas burner" wherein gas from inlet 36 under a pressure of a gas source is mixing in parallel streams with air from low pressure plenum blower 38 e.g. 250 Pa (25 mm W.C.) in an amount from about 100% and more of stoichiometric requirement for complete combustion. The burner 30 is ending by nozzle 32, extending through the bottom end 28 into the flue pipe 20. The nozzle 32 has a tangential direction to the flue pipe inside surface and is directed aslant up from horizontal by angles e.g. 20°. The nozzle is shown in FIG. 1 has a top end 34 in horizontal plane.

A jet of gas/air mixture blowing tangential and aslant up into the flue pipe with velocity e.g. about 20 meters/sec imparts a whirling stream of gases flow upward with a high thermal conductance factor to the flue pipe inside surface. Moreover, a whirling stream flame constantly is flaming a gas/air mixture jet by contact with itself.

The bottom end of the flue pipe 20 has inside flange 42, tightly connected or welded to the bottom 18 of the tank and/or flue pipe 20. The flange 42 means to prevent exit down outside whirling stream flame. The flange opening diameter is smaller then about 0.7 of flue pipe diameter. It depends on a thickness of layer of a whirl stream fuel/air mixture at the end of the flue pipe which in turn depends on different factors, e.g., a quantity of issue, velocity of a jet, direction of the nozzle etc.

Figure 5:
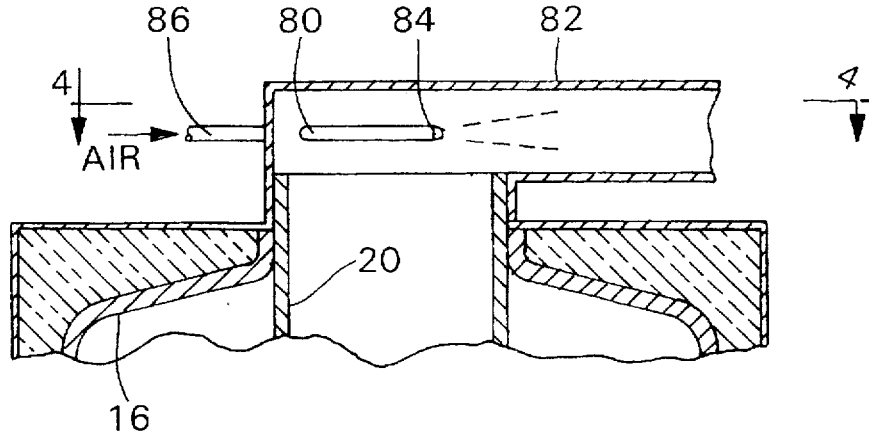
FIG. 5 is a schematic side view in cross-section taken on line 6—6 of FIG. 6 to illustrate a top portion of another embodiment with tangential outlet for gases and an injector.
Figure 6:
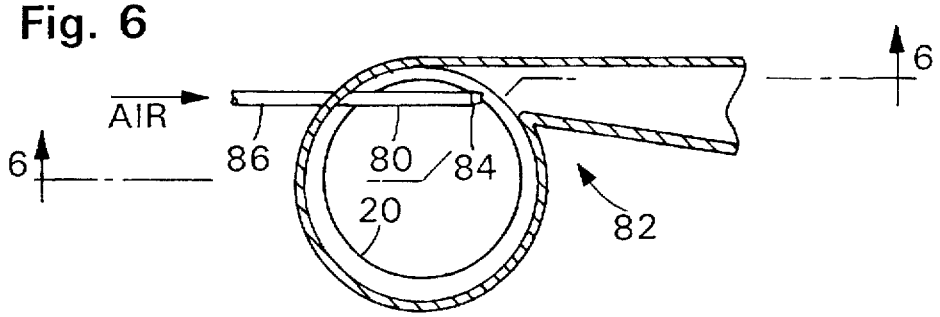
FIG. 6 is a schematic top view in cross-section taken on line 4—4 of FIG. 5 to illustrate the tangential outlet of gases with the injector.

In FIG. 1 is shown a top cover 78 on the flue pipe 20 with a central circular opening 76 for outlet of products of combustion under the action of natural draft hot gases and directed vertical up component of a force from aslant up blowing jet of the fuel/air mixture. Another embodiment outlet for the products of combustion is shown in FIG. 5 and 6. Gases that are blown by action of directed tangential force from a whirling stream products of combustion and by action of draft created by injector 80 (which is connected with the said plenum blower 38) go through horizontal tangential outlet 82. Said tangential outlet can be used with or without an injector in any embodiments of this invention and so to convey gases outside of building.

Turning now to the bottom portion of the water heater. The bottom 18 has a circular recess 44 around flue pipe 20. A cold water inlet 70 runs from a source of cold water through the tank 12 into its bottom portion right up to said recess 44. The nozzle 72 of cold water inlet directed tangential to the fuel pipe 20 and horizontal or island down into the recess 44 at an angle to about 15°. The jet-like stream of cold water from nozzle 72 under a pressure of the cold water source has a suitable velocity to form whirling stream of water in recess 44 preventing the tendency of solid particles to precipitate out of the water. The said stream of cold water washes off the precipitate that was accumulated before in the recess 44 and on bottom of the tank 18, at the time when hot water was not withdrawn and, therefore, there was not any movement of water in the tank.

Figure 3:
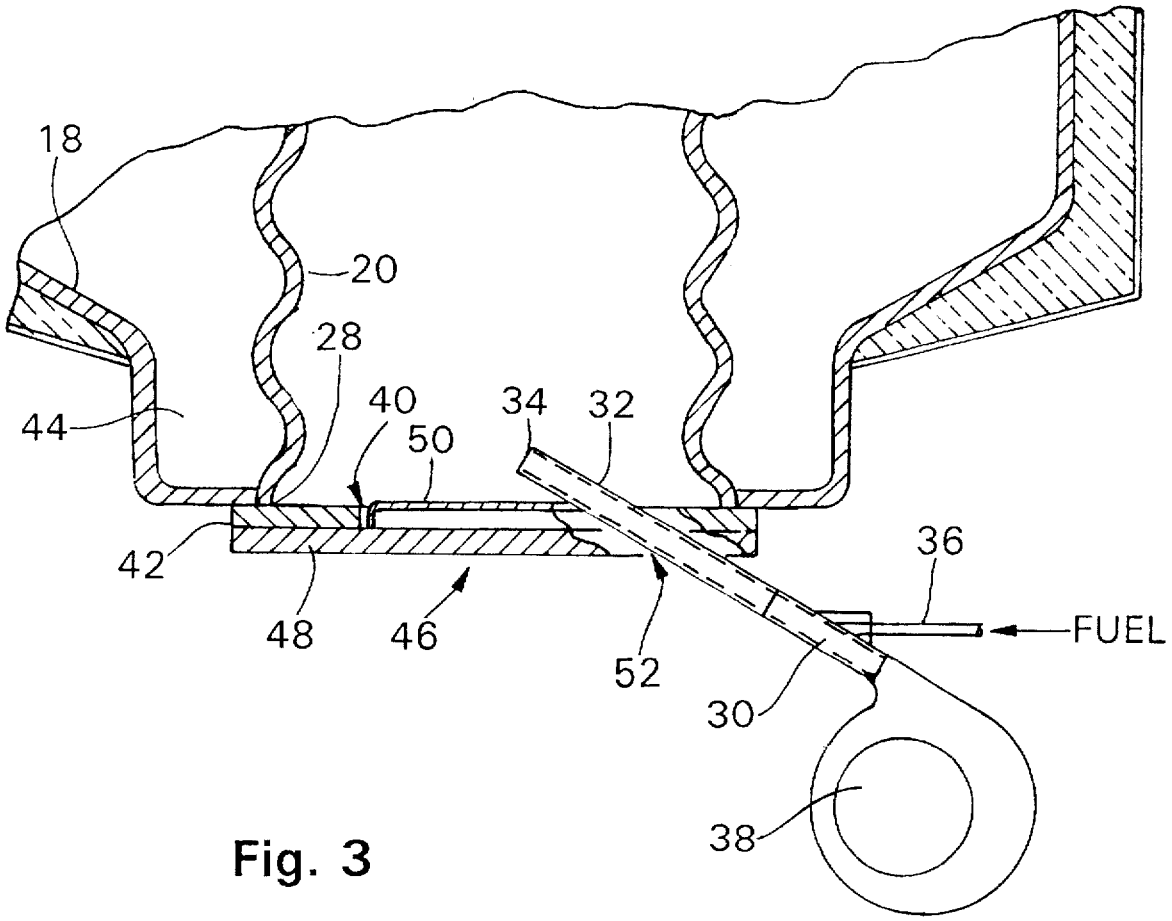
FIG. 3 is a schematic cross-sectional side view of bottom portion of another embodiment of this invention with removable bottom wall made from a high thermal conducting plate with reflection screen and the wavy surface of the flue pipe.

Furthermore, the whirling water stream going around bottom portion of the flue pipe 20 is necessary for cooling flue pipe to avoid damage of metal from whirling stream of flame with the highest temperature. The central circular opening 40 in the bottom flange of the flue pipe 42 can be closed by removable bottom end 46 as it is shown in FIG. 3. This bottom end includes a plate 48 made from a high thermal conductivity metal plate, covered by reflection screen from fireproof well reflective metal. There is an air yawn used as a thermo-insulation between reflection screen and thermal conductivity plate. That removable bottom construction limits a loss of heat through said flue pipe opening. Most of the heat that would be lost otherwise is returned to the flue pipe wall 20 by reflection from the screen 50 and by transfer through high thermal conductivity plate 48. In said bottom 46 there is a hole 52 for burner's nozzle 32.

In FIG. 3 is also shown a wavy structural shape of the flue pipe for more surface to be a conducting area for heat transfer from hot gases to water.

Figure 4:
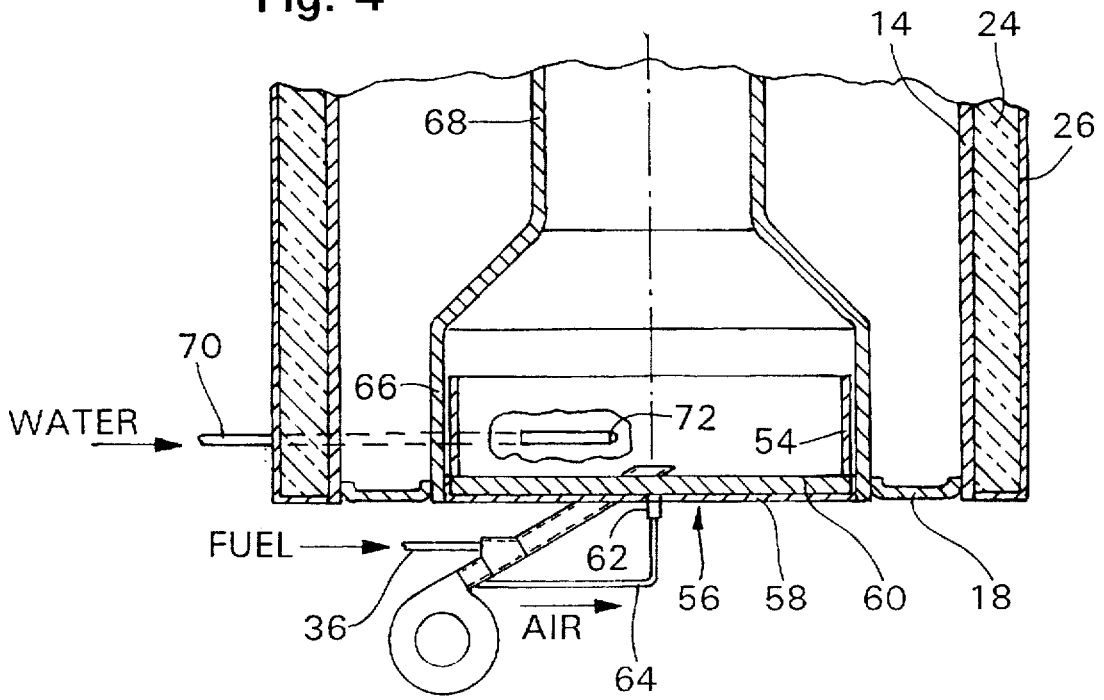
FIG. 4 is a schematic cross-sectional side view of bottom portion of another embodiment of this invention in which diameter of bottom portion of the flue pipe is larger then its upper portion. As well there are shown a fireproof protected screen of the flue pipe and an air-cooling removable bottom with penetrating insulation material.

FIG. 4 shows another variant of construction of bottom portion of the tank. In this variant diameter of lower portion of the flue pipe 66 is larger than diameter of its upper portion 68. In this case a wide bottom opening of the flue pipe is covered by removable fireproof bottom end 56. It includes a body 58 made from metal sheet filled up by penetrating insulation 60. There is an air inlet 62 on the external side of the bottom 36 which is connected with plenum blower 38 by a tube 64. In this removable bottom construction heat, that would be lost otherwise through the flue pipe opening, is taken up by penetrating insulation and blown with air back into the flue pipe through said penetrating insulation.

The lower portion of the flue pipe 66 is protected by a fireproof tube screen 54. Said fireproof tube screen as well as removable fireproof bottom may be used in certain embodiments of the present invention.

Since each embodiment of this invention has well known in the art and used for the same purpose system for control and operation, including spark ignition, hot water outlet and/or pilot, description of that means is deemed unnecessary.

I claim:

1. A high efficiency water heater comprising:

a water tight tank adapted to contain hot water under pressure, said tank including a tank walls, top and bottom head members, and a flue pipe with a circle-shaped cross section extending vertically through the tank from the bottom to the top, the flue pipe having a top end and a bottom end with an opening defined at each end;

a low pressure plenum blower which supplies air for combustion of fuel under a pressure of at least approximately 100 Pa (10 mm W.C.);

a burner which is adapted to receive fuel from a fuel source and air from said plenum blower in an amount equal to at least 100% of the stoichiometric requirement for complete combustion of the fuel, which mixes the fuel and the air and issues a fuel/air mixture through the bottom end of the flue pipe into the fuel pipe through the use of a nozzle, said nozzle has a tangential direction to the inside surface of the flue pipe and is directed aslant up from horizontal at an angle of about 5° to about 45°; and a cold water inlet tube which passes through and is fixed to said tank.

2. The water heater as in claim 1 wherein said vertical flue pipe has a top cover with a central circular opening.

3. The water heater as in claim 1 wherein said vertical flue pipe has a tangential outlet on the top end for venting products of combustion.

4. The water heater as in claim 1 wherein said vertical flue pipe has a wavy surface in which waves go around one above another at an angle to horizontal of 0° to about 30°.

5. The water heater as in claim 1 wherein the bottom end of the vertical flue pipe has an inside flange with a central circular opening defined therethrough, the central opening has a diameter which is smaller than about 70% of a diameter of said flue pipe.

6. The water heater as in claim 1 wherein the bottom end of the vertical flue pipe is closed by a removable bottom wall with a hole for the nozzle of the burner.

7. The water heater as in claim 6 wherein said removable bottom wall is made from a high thermal conducting plate with a reflection screen located above with an air yawn between said plate and screen.

8. The water heater as in claim 1 wherein lower portion inside surface of the vertical flue pipe is protected by a concentric fire proof tube screen which is placed into flue pipe.

9. The water heater as in claims 6 wherein said removable bottom wall is made from a metal sheet body with an air penetrating thermo-insulation material, said metal sheet body has an air inlet connected with said plenum blower by a tube.

10. The water heater as in claim 1 wherein said nozzle for issuing the fuel/air mixture into the fuel pipe has a top end with an opening which is located in a plane oriented from approximately horizontal to about an angle at 90° to an axis of the nozzle.

11. The water heater as in claim 1, wherein there is an injector to exhaust products of combustion located at the top opening of the flue pipe.

12. The water heater as in claim 1 wherein the tank has a circular recess around the vertical flue pipe, the cold water inlet nozzle is placed into said recess and is directed approximately tangential to said flue pipe and aslant down from horizontal at an angle of up to about 15°.

13. The water heater as in claim 12 wherein said cold water inlet tube passes through and is attached to a bottom portion of the tank.

14. Method of combusting fuel, venting, and heating water in a high efficiency water heater with a vertical flue pipe comprising the steps of:

a) preparing a fuel/air mixture having at least 100% of a stoichiometric ratio requirement of air for complete combustion;

b) blowing the fuel/air mixture into the vertical flue pipe in a tangential direction to an inside surface of the flue pipe and aslant up from horizontal at an angle of about 5° to about 45°;

c) combusting the fuel/air mixture by contact with a whirling stream flame in the flue pipe and completely combusting the fuel/air mixture in the whirling stream flame creating whirling stream products of combustion;

d) mixing and rotating water around the flue pipe under action of a discharging cold water input to increase heat transfer from the flue pipe to the water and prevent sedimentation on a bottom portion of the tank;

e) heating water surrounding the flue pipe by heat transfer from the whirling stream products of combustion; and f) venting the products of combustion through a flue pipe top opening under a vertically upwardly directed natural draft of the products of combustion and an upwardly directed portion of a blower force which blows the fuel/air mixture into the flue pipe.

15. Method as in claim 14 wherein blowing in the fuel/air mixture directly impinges on a fireproof tube screen surface which is used as catalyst and stabilizer of the burning.

16. Method as in claim 14 wherein a directed tangential force from the whirling stream products of combustion is also used for venting products of combustion through a tangential outlet located at the flue pipe top opening.

17. Method as in claim 14 wherein venting products of combustion from the flue pipe increases by use of injector, connected with the said plenum blower.

18. The water heater of claim 11 wherein said injector is connected to the plenum blower by a tube.

* * * * *